US011043188B2

(12) United States Patent
Zhai et al.

(10) Patent No.: US 11,043,188 B2
(45) Date of Patent: Jun. 22, 2021

(54) DRIVING METHOD FOR PULSE WIDTH AND VOLTAGE HYBRID MODULATION, DRIVING DEVICE AND DISPLAY DEVICE

(71) Applicant: SHANGHAI AVIC OPTO ELECTRONICS CO., LTD., Shanghai (CN)

(72) Inventors: Yingteng Zhai, Shanghai (CN); Liang Xing, Shanghai (CN); Tianyi Wu, Shanghai (CN)

(73) Assignee: SHANGHAI AVIC OPTO ELECTRONICS CO., LTD., Shanghai (CN)

( * ) Notice: Subject to any disclaimer, the term of this patent is extended or adjusted under 35 U.S.C. 154(b) by 0 days.

(21) Appl. No.: 16/731,067

(22) Filed: Dec. 31, 2019

(65) Prior Publication Data

US 2021/0065655 A1 Mar. 4, 2021

(30) Foreign Application Priority Data

Aug. 30, 2019 (CN) ..... 201910817500.7

(51) Int. Cl.
*G09G 5/10* (2006.01)
*G09G 3/3291* (2016.01)

(52) U.S. Cl.
CPC ..... *G09G 5/10* (2013.01); *G09G 3/3291* (2013.01); *G09G 2320/0633* (2013.01)

(58) Field of Classification Search
USPC ..... 345/76, 100
See application file for complete search history.

(56) References Cited

U.S. PATENT DOCUMENTS 5,874,932 A 2/1999 Nagaoka et al.
2006/0170623 A1* 8/2006 Naugler, Jr. ..... G09G 3/2081 345/76

(Continued)

FOREIGN PATENT DOCUMENTS

CN 102054427 A 5/2011
CN 104050928 A 9/2014

(Continued)

OTHER PUBLICATIONS

Song Yiqing et al; 'Implementation of TFT LCD Display System with High Gray Levels'; Industry and Mine Automation; Feb. 2012.

(Continued)

*Primary Examiner* — Tony O Davis
(74) *Attorney, Agent, or Firm* — Kilpatrick Townsend & Stockton, LLP

(57) ABSTRACT

The present disclosure discloses a driving method for pulse width and voltage hybrid modulation, a driving device and a display device, the method including: after receiving a frame image to be displayed, generating N sub-frame images from the received frame image to be displayed; then controlling a display panel to display each sub-frame image in turn, and controlling, when each sub-frame image is displayed, the sub-pixel that needs to emit light in the sub-frame image to emit light according to the corresponding light-emitting brightness in the light-emitting period corresponding to the sub-frame image. In one sub-frame image, the light-emitting brightness of the sub-pixel is determined by the display brightness corresponding to the sub-pixel in the frame image to be displayed, and the light-emitting time configured for the sub-frame image.

13 Claims, 10 Drawing Sheets

(56) References Cited

U.S. PATENT DOCUMENTS

| | | | | |
|---|---|---|---|---|
| 2007/0115222 | A1* | 5/2007 | Shimada | G09G 3/3283 345/76 |
| 2018/0197479 | A1* | 7/2018 | Chen | G09G 3/3233 |
| 2019/0279553 | A1* | 9/2019 | Vahid Far | G09G 3/3225 |

FOREIGN PATENT DOCUMENTS

| | | | |
|---|---|---|---|
| CN | 106910449 | A | 6/2017 |
| CN | 107016955 | A | 8/2017 |
| CN | 107993609 | A | 5/2018 |
| DE | 102017130445 | A1 | 6/2018 |
| JP | 2008170768 | A | 7/2008 |
| KR | 20080113846 | A | 12/2008 |

OTHER PUBLICATIONS

Li Hong Qin; 'New Method of Grayscale Modulation for OLED Display'; College of Electrical and Electronic Engineering , Shanghai University of Engineering Science , Shanghai 201620 ,China.

* cited by examiner

DRIVING METHOD FOR PULSE WIDTH AND VOLTAGE HYBRID MODULATION, DRIVING DEVICE AND DISPLAY DEVICE

CROSS-REFERENCE TO RELATED APPLICATION

This application claims priority to Chinese Patent Application No. CN201910817500.7 filed to the Chinese Patent Office on Aug. 30, 2019, the content of which is incorporated by reference in the entirety.

FIELD

The present disclosure relates to the field of display, in particular to a driving method for pulse width and voltage hybrid modulation, a driving device and a display device.

BACKGROUND

Organic light emitting diode (OLED) display is one of the hot spots in the field of flat panel display research. Compared with LCD, OLED display has the advantages of low energy consumption, low production cost, self-illumination, wide viewing angle and high response speed. At present, OLED display has begun to replace traditional Liquid Crystal Display (LCD) in the field of mobile phones, PDA and digital cameras as well as other flat panel display fields.

At present, the Pulse-Width Modulation (PWM) driving method is generally used to control the brightness of OLED display. In this method, one frame time is divided into several sub-frames, and each sub-frame corresponds to a pulse cycle. In each pulse cycle, a low level indicates that the sub-pixel emits light, and a high level indicates that the sub-pixel does not emit light. Therefore, in one frame time, with the increase of the duty cycle of the low level, the light emitting time of the sub-pixel will become longer, and correspondingly, the brightness of the display becomes higher.

SUMMARY

An embodiment of the present disclosure provides a driving method for pulse width and voltage hybrid modulation, a driving device and a display device.

One embodiment of the present disclosure provides a driving method for pulse width and voltage hybrid modulation. The method comprises:

receiving a frame image to be displayed;

determining there are N sub-frame images to be generated in the frame image to be displayed according to a quantity of sub-frames N in one frame in a preset PWM framework;

configuring a light-emitting time for each of N sub-frame images to be generated, and N is a positive integer greater than 1;

generating N sub-frame images from the frame image to be displayed according to the light-emitting time for the each of the N sub-frame images to be generated;

and, light-emitting brightness corresponding to each of the N sub-frame images is determined by display brightness corresponding to each sub-pixel in the frame image to be displayed and the light-emitting time configured for the each of the N sub-frame images; and the light-emitting brightness of the sub-pixel lies in a preset brightness range that is greater than or equal to the minimum light-emitting brightness of the sub-pixel and less than or equal to maximum light-emitting brightness of the sub-pixel; and controlling a display panel to display the N sub-frame images in turn, and controlling, when the each of the N sub-frame images is displayed, a sub-pixel that needs to emit light in the each of N sub-frame images to emit light according to corresponding light-emitting brightness in the light-emitting time corresponding to the each of the N sub-frame images.

One embodiment of the present disclosure also provides a driving device, which comprises:

a receiving device configured to receive a frame image to be displayed;

a data generating device configured to: determine there are N sub-frame images to be generated in the frame image to be displayed according to a quantity of sub-frames N in one frame in a preset PWM framework; configure a light-emitting time for each of N sub-frame images to be generated, and N is a positive integer greater than 1; and generate N sub-frame images from the frame image to be displayed according to the light-emitting time for the each of the N sub-frame images to be generated; and, light-emitting brightness corresponding to each sub-pixel in each of the N sub-frame images is determined by display brightness corresponding to each sub-pixel in the frame image to be displayed and the light-emitting time configured for the each of the N sub-frame images; and the light-emitting brightness of the sub-pixel lies in a preset brightness ranges that is greater than or equal to minimum light-emitting brightness of the sub-pixel and less than or equal to maximum light-emitting brightness of the sub-pixel; and a control device configured to control a display panel to display the N sub-frame images in turn, and control, when the each of the N sub-frame images is displayed, a sub-pixel that needs to emit light in the each of N sub-frame images to emit light according to corresponding light-emitting brightness in the light-emitting time corresponding to the each of the N sub-frame images.

One embodiment of the present disclosure also provides a display device, including a display panel, and the driving device provided in the embodiment of the present disclosure; where the driving device is used to drive the display panel to display.

DETAILED DESCRIPTION OF THE EMBODIMENTS

Since, with the current PWM driving method, when the display needs to display the brightness of a lower gray scale, for example, when the display needs to display the brightness of 1 gray scale which is 1/200000 of the brightness of 255 gray scale, if light is emitted within a whole frame time to fulfill the brightness of 255 gray scale, the light-emitting time should be controlled to 1/200000 of one frame time to display the brightness of 1 gray scale, that is, a pulse width of 1/200000 of one frame is needed. However, one frame time is generally short, and 1/200000 time of one frame is shorter. Therefore, it is difficult to accurately generate a pulse width of 1/200000 frame for brightness modulation.

The embodiment of the present disclosure provides a driving method for pulse width and voltage hybrid modulation, a driving device and a display device.

The driving method for pulse width and voltage hybrid modulation, the driving device and the display device provided in the embodiment of the present disclosure will be described in detail in combination with the attached drawings.

Figure 1:
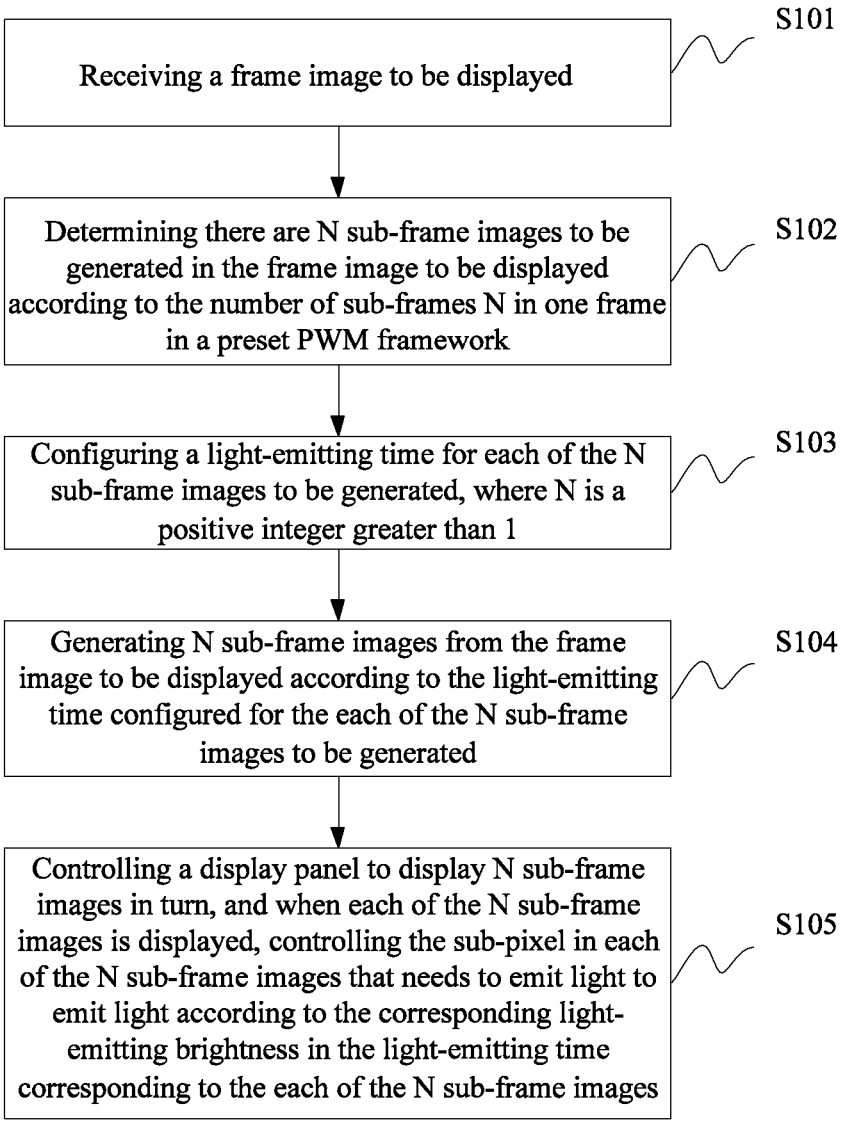
FIG. 1 is a schematic flow diagram of a driving method provided in an embodiment of the present disclosure.

The embodiment of the present disclosure provides the driving method for pulse width and voltage hybrid modulation. As shown in FIG. 1 which is a flow diagram of a driving method provided in an embodiment of the present disclosure, the driving method includes:

S101: receiving a frame image to be displayed;

S102: determining there are N sub-frame images to be generated in the frame image to be displayed according to the number of sub-frames N in one frame in a preset PWM framework;

S103: configuring a light-emitting time for each of the N sub-frame images to be generated, where N is a positive integer greater than 1;

S104: generating N sub-frame images from the frame image to be displayed according to the light-emitting time configured for the each of the N sub-frame images to be generated;

where the light-emitting brightness corresponding to each sub-pixel in each of N sub-frame images is determined by the display brightness corresponding to each sub-pixel in the frame image to be displayed and the light-emitting time configured for the each of the N sub-frame images, and the light-emitting brightness corresponding to the each sub-pixel belongs to a preset brightness range that is greater than or equal to the minimum light-emitting brightness of the sub-pixel and less than or equal to the maximum light-emitting brightness of the sub-pixel; and

S105: controlling the display panel to display N sub-frame images in turn, and when each of the N sub-frame images is displayed, controlling the sub-pixel in each of the N sub-frame images that needs to emit light to emit light according to the corresponding light-emitting brightness in the light-emitting time corresponding to the each of the N sub-frame images.

According to driving method for pulse width and voltage hybrid modulation provided in the embodiment of the present disclosure, after the frame image to be displayed is received, N sub-frame images are determined to be generated from the received frame image to be displayed according to the number of the sub-frames N in one frame in the preset PWM framework, N sub-frame images are generated from the frame image to be displayed after the light-emitting time and corresponding light-emitting brightness are configured for each of the N sub-frame images; then the display panel is controlled to display the N sub-frame images in turn; and when each of the N sub-frame images is displayed, the sub-pixel that needs to emit light in the sub-frame image is controlled to emit light according to the corresponding light-emitting brightness in the light-emitting time corresponding to each of the N sub-frame images. In one sub-frame image, the light-emitting brightness of the sub-pixel is determined by the display brightness corresponding to the sub-pixel in the frame image to be displayed, and the light-emitting time configured for the sub-frame image. The light-emitting brightness corresponding to each sub-pixel lies in the range that is greater than or equal to the minimum light-emitting brightness of the sub-pixel and less than or equal to the maximum light-emitting brightness of the sub-pixel. That is, in each sub-frame image, the display brightness of the sub-pixel is not only determined by the light-emitting time of the light-emitting sub-frame, but also by the light-emitting brightness of the sub-pixel, and the light-emitting brightness of the sub-pixel is determined by the data voltage. Therefore, compared with the simple PWM modulation, adjustment of the data voltage is added so that the low gray scale brightness can be accurately displayed, and the number of sub-frames can be fewer.

In some embodiments, for example, for simple PWM modulation, the light-emitting time of each sub-frame is fixed, and the display brightness is determined by the number of sub-frames that need to emit light. In order to realize the display of various degrees of gray-scale brightness, sub-frames need to be set. In the embodiment of the present disclosure, the display brightness of each sub-frame image is not only determined by the light-emitting time, but also can be further refined and adjusted through the data voltage after the light-emitting time is fixed, which means that different from simple PWM modulation where only display brightness being lit on and display brightness being off states are configured for each sub-frame image, in the embodiment of the present disclosure, various levels of display brightness including display brightness being off and display brightness being lit on with different data voltage are configured for each sub-frame image. Therefore, according to the present disclosure accurate display of the low gray scale brightness by adjusting the light-emitting time and data voltage together. Moreover, since various levels of display brightness can be realized in each sub-frame in the embodiment of the present disclosure, the brightness of each gray scale can be displayed with fewer sub-frames.

It should be noted that in the embodiment of the present disclosure, the light-emitting brightness of the sub-pixel is determined by the driving current of the light-emitting sub-pixel, while the driving current is determined by the data voltage for the sub-pixel. The display brightness of the sub-pixel in the $i^{th}$ sub-frame is $$L(i) = \frac{T_i L_i}{T_f},$$

the display brightness of the sub-pixel in one frame time is $$S_N = \sum_{i=1}^{N} \frac{T_i L_i}{T_f},$$

and the display brightness corresponding to the sub-pixel in the frame image to be displayed is $$L = S_N = \sum_{i=1}^{N} \frac{T_i L_i}{T_f}.$$

Where, $T_i$ represents the light-emitting time of the $i^{th}$ sub-frame, $T_f$ represents one frame time, and $L_i$ represents the light-emitting brightness of the sub-pixel in the $i^{th}$ sub-frame.

In one or more embodiments, one sub-frame time usually includes a light-emitting period and a non-light-emitting period, where the light-emitting period is used for lighting the sub-pixel for display, and the non-light-emitting period is generally used for writing data. Therefore, the sum $$\sum_{i=1}^{N} T_i$$

of the light-emitting period corresponding to the N sub-frames is less than the time $T_f$ of one frame.

Figure 2:
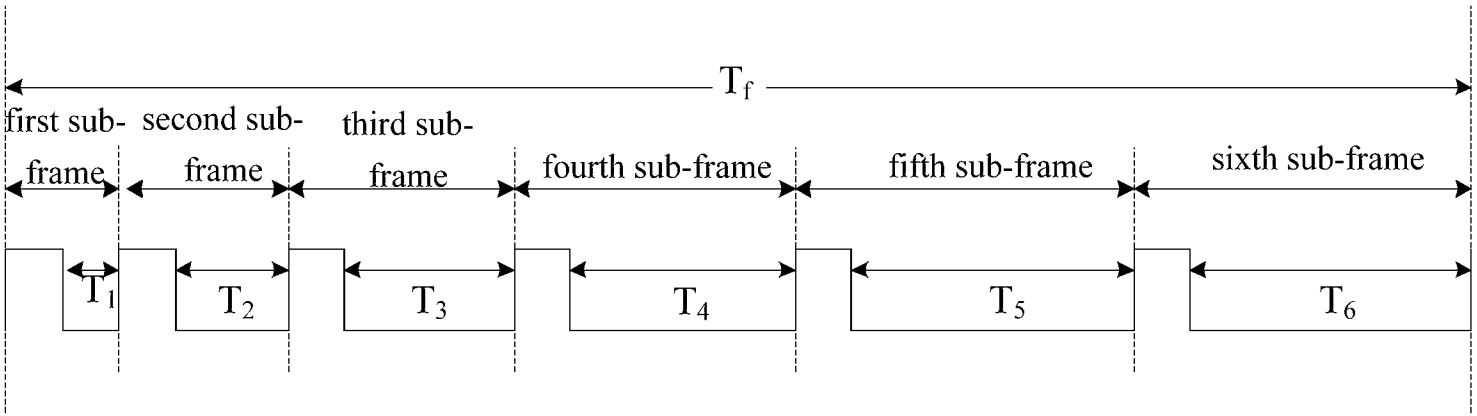
FIG. 2 is a schematic diagram of the light-emitting time of sub-frames in a driving method provided in an embodiment of the present disclosure.

In one or more embodiments, in the driving method provided in the embodiment of the present disclosure, configuring a light-emitting time for each of the N sub-frame images to be generated includes: configuring different light-emitting times for the N sub-frame images to be generated respectively;

In one or more embodiments, taking N=6 as an example and referring to FIG. 2 which is a schematic diagram of the light-emitting time of sub-frames in a driving method provided in an embodiment of the present disclosure. In FIG. 2, a low level represents that the sub-pixel emits light and T1<T2<T3<T4<T5<T6. As such, there are both sub-frames with shorter light-emitting times and sub-frames with longer light-emitting times in one frame, where the sub-frames with shorter light-emitting times are configured to facilitate the display of low gray scale brightness, and through the configuration of the sub-frames with longer light-emitting times, the display of high gray scale brightness can be realized with fewer sub-frames. In one or more embodiments, due to the low sensitivity of the human eye to the high gray scale brightness, the accuracy does not need to be too high for the display of high gray scale brightness, so the light-emitting time of the sub-frame can be set to be a little longer to realize fewer sub-frames in one frame time.

Of course, in one or more embodiments, it is also possible to configure the same light-emitting time for all of the N sub-frame images to be generated, or configure the same light-emitting time for some of the N sub-frame images to be generated, and there is no limitation in this aspect.

In one or more embodiments, in the driving method provided in the embodiment of the present disclosure, a light-emitting time is configured for each of the N sub-frame images to be generated according to the following formula:

$$T_i \propto \gamma\left(\frac{i}{N} G_M\right);$$

where $T_i$ represents the light-emitting time corresponding to the $i^{th}$ sub-frame, $G_M$ represents the maximum gray scale value of the display panel, and γ represents the mapping relationship between the gray scale value and the display brightness value. In this way, the brightness of gray scale can be further accurately displayed by configuring the light-emitting time according to the gamma curve.

Figure 3:
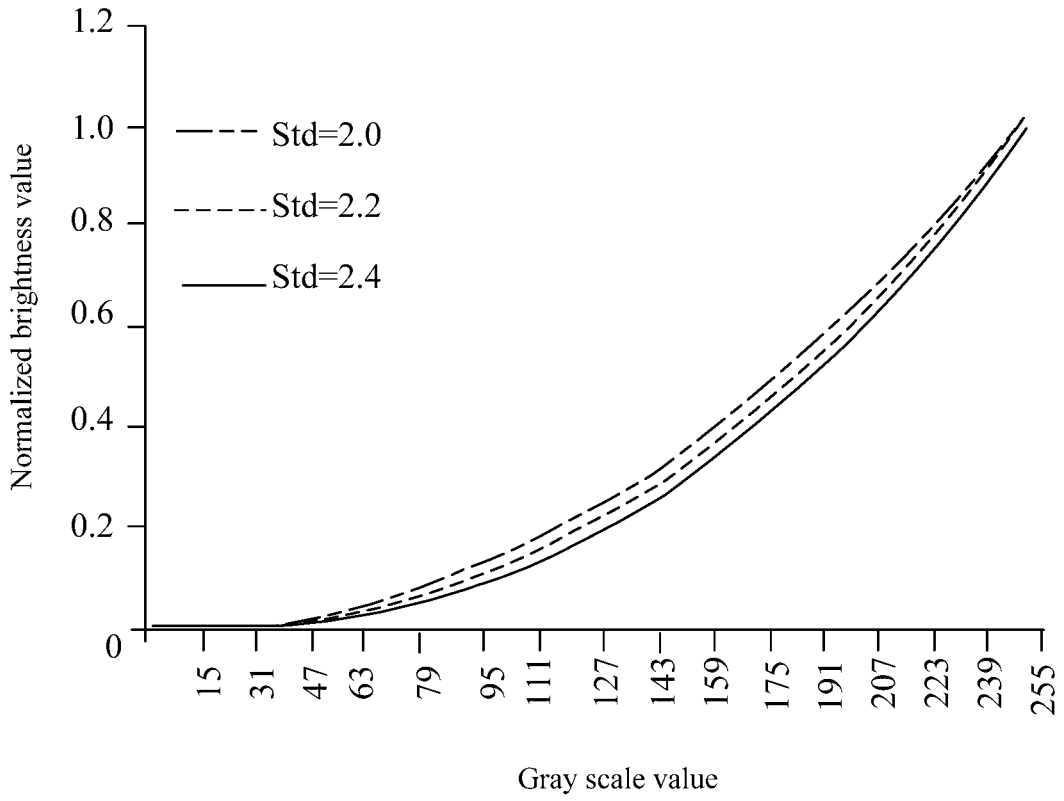
FIG. 3 is a schematic diagram of gamma curve.

In practical application, the gray scale represents different levels of brightness from the darkest to the brightest. The more levels, the finer the image effect can be presented. The minimum gray scale value of the display panel is 0, and the maximum gray scale value is generally 31, 63, 127 or 255. In one or more embodiments, the gray scale value G and the brightness value L are distributed in the gamma curve as shown in FIG. 3. The relationship between the gray scale value G and the brightness value L is: L=γ(G), and generally γ(G)∝GStd, where Std=2.0, 2.2 or 2.4.

Since the display brightness is modulated by the pulse width and the voltage together, compared with the pure pulse width modulation, the driving method provided in the embodiment of the present disclosure can not only realize the accurate display of low gray scale brightness, but also can realize the display of low gray scale brightness with fewer sub-frames.

In one or more embodiments, for the PWM modulation, N is at least 2 and generally greater than 10. However, the larger N is, the more times data needs to be written in one frame time, thus the greater the power consumption is, and the higher the process requirements of the display panel are. The driving method provided in the embodiment of the present disclosure can be realized with fewer sub-frames because of the pulse width and voltage hybrid modulation. In one or more embodiments of the present disclosure, the smaller the number of sub-frames is, the lower the precision of the display brightness is, and the lower the power consumption of the display panel is; the larger the number of sub-frames is, the higher the precision of the display brightness is, and the higher the power consumption of the display panel is. Therefore, after considering the two cases, in the driving method provided in the embodiment of the present disclosure, 4≤N≤6 is selected, so that fewer sub-frames can be adopted while the low gray scale brightness is accurately controlled. Of course, in other embodiments, N can also be set to other integers greater than 6 or less than 4, which is not limited here.

Next, the step S104 of generating N sub-frame images from the received frame image to be displayed in the embodiment of the present disclosure will be described in detail.

Figure 4:
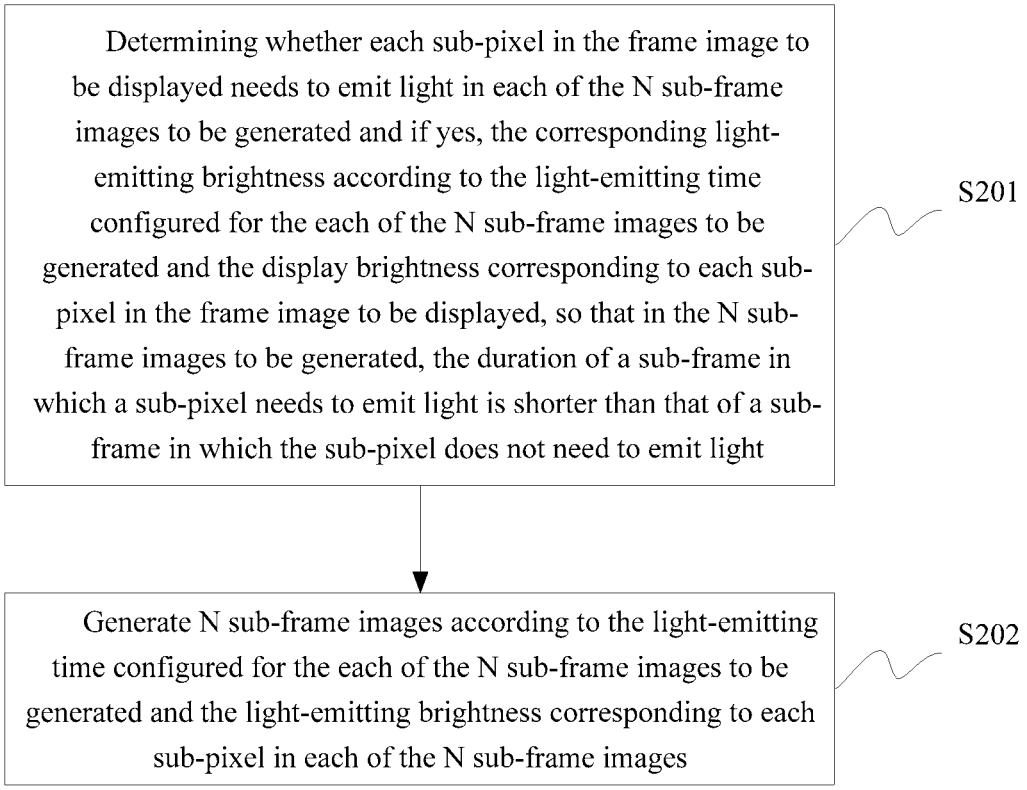
FIG. 4 is a schematic flow diagram of a driving method provided in another embodiment of the present disclosure.

In one or more embodiments, in the driving method provided in the embodiment of the present disclosure, generating N sub-frame images from the received frame image to be displayed, as shown in FIG. 4, which is a flow diagram of a driving method provided in another embodiment of the present disclosure, includes:

S201: determining whether each sub-pixel in the frame image to be displayed needs to emit light in each of the N sub-frame images to be generated and if yes, the corresponding light-emitting brightness according to the light-emitting time configured for the each of the N sub-frame images to be generated and the display brightness corresponding to each sub-pixel in the frame image to be displayed, so that in the N sub-frame images to be generated, the duration of a sub-frame in which a sub-pixel needs to emit light is shorter than that of a sub-frame in which the sub-pixel does not need to emit light; and S202: generating N sub-frame images according to the light-emitting time configured for the each of the N sub-frame images to be generated and the light-emitting brightness corresponding to each sub-pixel in each of the N sub-frame images.

In the above driving method provided in the embodiment of the present disclosure, when determining whether each sub-pixel in the frame image to be displayed needs to emit light in each sub-frame and the corresponding light-emitting brightness when the sub-pixel needs to emit light, it is necessary to meet the requirement that the duration of a sub-frame in which a sub-pixel needs to emit light is shorter than that of a sub-frame in which the sub-pixel does not need to emit light. That is, for light-emitting brightness distribution, the sub-frames with the shortest light-emitting time should be used to the maximum extent, so that the low gray scale brightness can be displayed accurately. Taking N=6 as an example, six sub-frame images are generated according to the frame image to be displayed. Supposing that for the six sub-frame images, the corresponding light-emitting time meets T1<T2<T3<T4<T5<T6, and when it is determined that the sub-pixel needs to emit light in three sub-frames, the three sub-frames emitting light may be the first, second and third sub-frame.

Furthermore, in the driving method provided in the embodiment of the present disclosure, determining whether each sub-pixel in the frame image to be displayed needs to emit light in each of the N sub-frame images to be generated further includes:

presetting the light-emitting brightness for the sub-pixel in each of the N sub-frame images to be generated, and determining the display brightness of each of the N sub-frame images to be generated according to the preset light-emitting brightness and the light-emitting time of the each of the N sub-frame images to be generated;

when the number of light-emitting sub-frame images is n, the sum of the display brightness of n sub-frame images is greater than or equal to the display brightness of the frame image to be displayed, and when the sum of the display brightness of any n−1 sub-frame images in the n sub-frames is less than the display brightness of the frame image to be displayed, sub-pixels in other N-n sub-frame images do not need to emit light; where, n is a positive integer, and n=1~N.

In one or more embodiments, still taking N=6 as an example, supposing that the respective corresponding light-emitting time of the six sub-frame images meets T1<T2<T3<T4<T5<T6, determining whether each sub-pixel needs to emit light in each sub-frame image from any sub-frame in any order, which is no limited here. In one embodiment, determining whether the display brightness $$L(3) = \frac{T_3 L_3}{T_f}$$

of the third sub-frame is less than or equal to the display brightness of the frame image to be displayed from the third sub-frame. If yes, it is temporarily determined that the sub-pixel needs to emit light in the third sub-frame. Then the above operation may be repeated by selecting the fifth sub-frame, and when it is determined that the sum of the display brightness L (3) of the third sub-frame and the display brightness L (5) of the fifth sub-frame is greater than or equal to the display brightness of the frame image to be displayed. If yes, it is temporarily determined that the sub-pixel needs to emit light in the third sub-frame and the fifth sub-frame, and does not need to emit light in other sub-frames. Then, whether T3 and T5 are the two smallest light-emitting times needs to be determined, and T3 and T5 are not the two smallest light-emitting times here, so that further determination is needed. In one embodiment, the fifth sub-frame is replaced by the first sub-frame to determine whether the sum of the display brightness L (3) of the third sub-frame and the display brightness L (1) of the first sub-frame is greater than or equal to the display brightness of the frame image to be displayed. If yes, it is temporarily determined that the sub-pixel needs to emit light in the third sub-frame and the first sub-frame, and does not need to emit light in other sub-frames. Then, whether T3 and T1 are the two smallest light-emitting times is determined, and T3 and T1 are not the two smallest light-emitting times, so further determination is needed. In one embodiment, the third sub-frame is replaced by the second sub-frame to determine whether the sum of the display brightness L (1) of the first sub-frame and the display brightness L (2) of the second sub-frame is greater than or equal to the display brightness of the frame image to be displayed, and if yes, it is temporarily determined that the sub-pixel needs to emit light in the first sub-frame and the second sub-frame, and does not need to emit light in other sub-frames. At the same time, it is also necessary to determine whether T1 and T2 are the two smallest light-emitting times, and T1 and T2 are the two smallest light-emitting times here. Therefore, it can be finally determined that the sub-pixel needs to emit light in the first and second sub-frames, and do not need to emit light in other sub-frames.

In one or more embodiments, in the driving method provided in the embodiment of the present disclosure, determining whether each sub-pixel in the frame image to be displayed needs to emit light in each of the N sub-frame images to be generated further includes:

for each sub-pixel, from the sub-frame image with the shortest light-emitting time in the sequence of light-emitting time from short to long, determining whether the sub-pixel needs to emit light in the corresponding sub-frame image according to the preset light-emitting brightness, so that the calculation amount is reduced.

Still taking N=6 as an example, the light-emitting time corresponding to the sub-frame images of the six frames meets T1<T2<T3<T4<T5<T6 according to the sequence of light-emitting time from short to long. When determining whether each sub-pixel needs to emit light in each sub-frame image, whether the display brightness $$L(1) = \frac{T_1 L_1}{T_f}$$

of the first sub-frame is less than or equal to the display brightness of the frame image to be displayed is determined from the sub-frame image with the shortest emitting time, namely from the first sub-frame, and according to the sequence of light-emitting time from short to long. If yes, it is temporarily determined that the sub-pixel needs to emit light in the first sub-frame. Then the second sub-frame is selected to determine whether the sum of the display brightness L (1) of the first sub-frame and the display brightness L (2) of the second sub-frame is greater than or equal to the display brightness of the frame image to be displayed. If yes, it is determined that the sub-pixel needs to emit light in the first sub-frame and the second sub-frame, and does not need to emit light in other sub-frames. In this way, once it is determined that the sub-pixel needs to emit light in the first sub-frame and the second sub-frame, the determination can be stopped without further judgment, so that the calculation amount is reduced.

In one or more embodiments, in the driving method provided in the embodiment of the present disclosure, the preset light-emitting brightness can be any value in the preset light-emitting brightness range mentioned above. When the display brightness of the frame image to be displayed is high gray scale brightness, small preset light-emitting brightness may not be able to display the high gray scale brightness. Therefore, in one or more embodiments, the preset light-emitting brightness is the maximum light-emitting brightness of the sub-pixel.

Furthermore, in the driving method provided in the embodiment of the present disclosure, after the sub-frame in which the sub-pixel needs to emit light is determined, it is also necessary to determine the light-emitting brightness corresponding to the sub-pixel in the sub-frame that needs to emit light. In one or more embodiments, when determining the light-emitting brightness of the sub-pixel, the light-emitting brightness corresponding to the sub-frames in which the sub-pixel needs to emit light can be set to be equal. Of course, in some embodiments, the light-emitting brightness of the sub-pixel in the sub-frame with the longest light-emitting time is set to be less than or equal to the light-emitting brightness of the sub-pixel in any other light-emitting sub-frames.

Still taking N=6 as an example, the light-emitting time corresponding to the sub-frame images of the six frames meets T1<T2<T3<T4<T5<T6 according to the sequence of light-emitting time from short to long. Assuming that the sub-pixel needs to emit light in the first sub-frame, the second sub-frame and the third sub-frame, and does not need to emit light in other sub-frame, the light-emitting brightness of the sub-pixel in the third sub-frame is less than or equal to the light-emitting brightness of the sub-pixel in the first sub-frame and the second sub-frame respectively.

In one or more embodiments, in the driving method provided in the embodiment of the present disclosure, determining the light-emitting brightness of each sub-pixel in each of the N sub-frame images to be generated when it needs to emit light includes:

determining all the light-emitting brightness corresponding to the sub-pixel in the first sub-frame image to the $(n-1)^{th}$ sub-frame image to be equal to the maximum light-emitting brightness of the sub-pixel;

the light-emitting brightness $L_n$ corresponding to the sub-pixel in the $n^{th}$ sub-frame image is calculated according to the following formula:

$$L_n = \frac{L - S_{n-1}}{T_n} T_f$$

$$S_{n-1} = \sum_{i=1}^{n-1} \frac{T_i}{T_f} L_M;$$

where, $S_{n-1}$ represents the sum of the display brightness corresponding to the sub-pixel in the first n−1 sub-frame images, L represents the display brightness corresponding to the sub-pixel in the frame image to be displayed, $T_i$ represents the light-emitting time configured for the $i^{th}$ sub-frame image, $L_M$ represents the maximum light-emitting brightness of the sub-pixel, and $T_f$ represents one frame time.

Still taking N=6 as an example, the light-emitting time corresponding to the sub-frame images of the six frames meets T1<T2<T3<T4<T5<T6 according to the sequence of light-emitting time from short to long. Assuming that the sub-pixel needs to emit light in the first sub-frame, the second sub-frame and the third sub-frame, and does not need to emit light in other sub-frame, the light-emitting brightness corresponding to the sub-pixel in the first sub-frame and the second sub-frame is the maximum light-emitting brightness of the sub-pixel $L_M$. The sum of the display brightness corresponding to the sub-pixel in the first three sub-frames is the display brightness L corresponding to the sub-pixel in the frame image to be displayed. According to L=L(1)+L(2)+L(3) where $$L(1) + L(2) = S2 = \sum \frac{T_1 L_M}{T_f} + \frac{T_2 L_M}{T_f},$$

the display brightness L(3) corresponding to the sub-pixel in the third sub-frame must meets $$L(3) = \frac{T_3 L_3}{T_f} = L - S_2,$$

so the light-emitting brightness corresponding to the sub-pixel in the third sub-frame can be deduced as $$L_3 = \frac{L - S_2}{T_3} T_f.$$

That is, in the driving method provided in the present disclosure, under the premise of lighting the sub-frame image with the shortest light-emitting time, the voltage modulation is used to control the light-emitting brightness of the sub-frame image, to accurately control the display brightness.

In one or more embodiments, in the driving method provided in the embodiment of the present disclosure, when the display panel is controlled to display the N sub-frame images in turn, the N sub-frame images can be displayed in any order in turn, which is not limited here.

Figure 5:
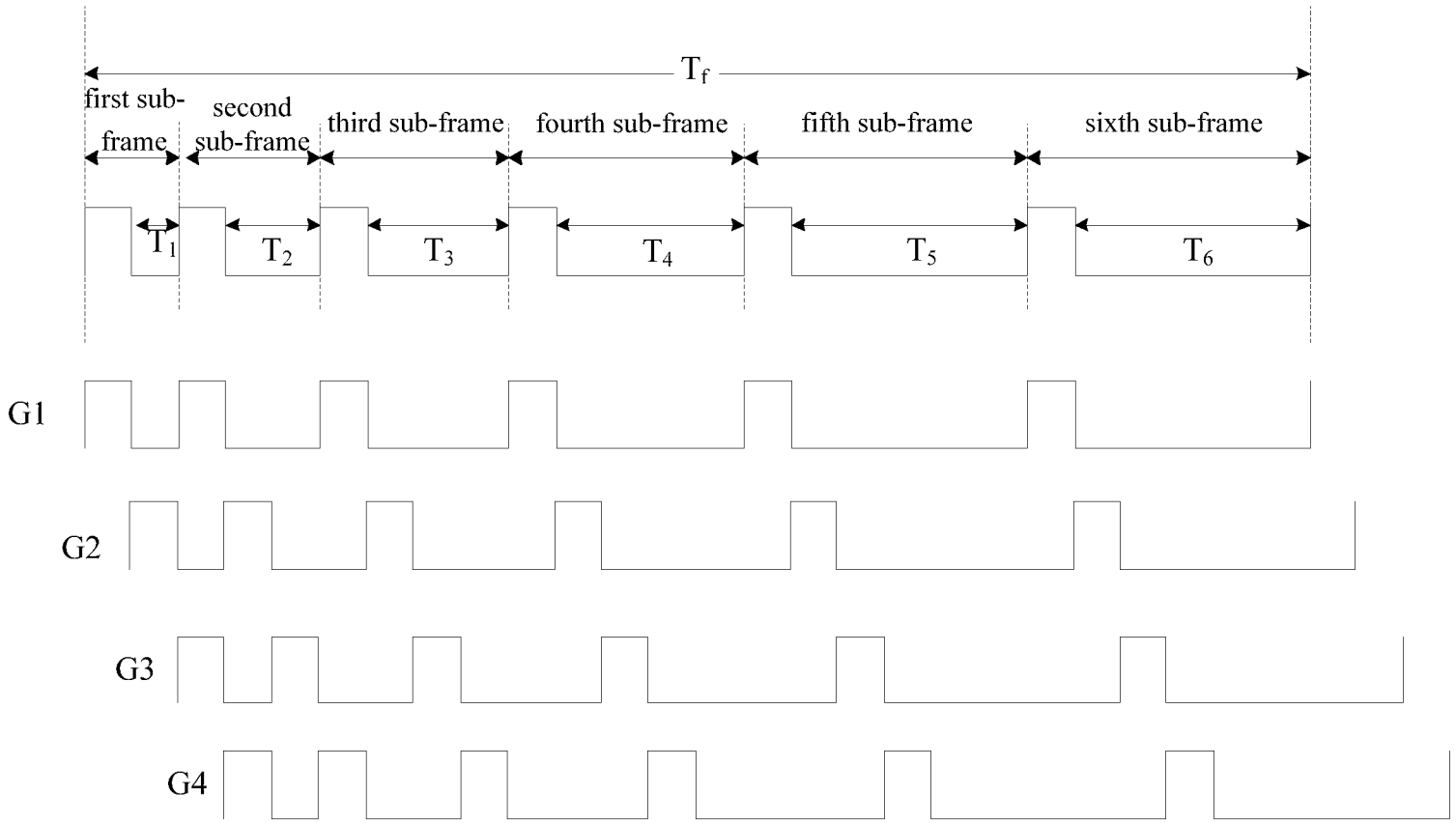
FIG. 5 is a timing chart to illustrate display of a frame image to be displayed by a display panel in an embodiment of the present disclosure.

In one or more embodiments, the display panel is controlled to display the N sub-frame images in turn in the order of the light-emitting time configured for each sub-frame image from short to long. As shown in FIG. 5 which is a timing chart to illustrate the display of a frame image to be displayed by the display panel in an embodiment of the present disclosure, each row of the sub-pixels (FIG. 5 shows four rows of sub-pixel G1-G4 as an example) displays each sub-frame image in turn according to the sequence of light-emitting time $T_i$ from short to long.

Figure 6:
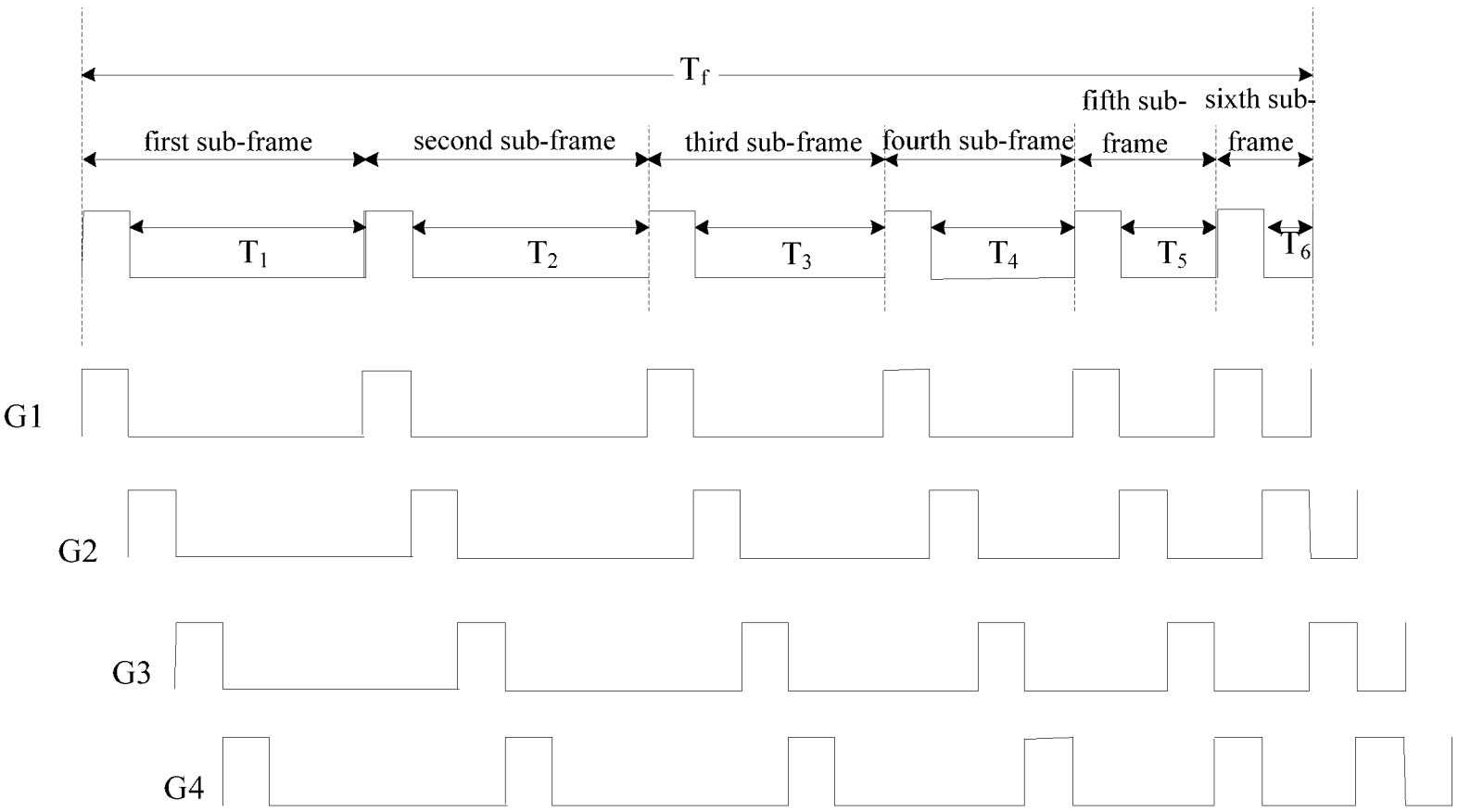
FIG. 6 is a timing chart to illustrate display of a frame image to be displayed by a display panel in another embodiment of the present disclosure.

In one or more embodiments, in the driving method provided in the embodiment of the present disclosure, controlling the display panel to display each sub-frame image in turn refers to: the display panel is controlled to display each sub-frame image in turn according to the order of the light-emitting time configured for the sub-frame image from long to short. Referring to FIG. 6 which is a timing chart to illustrate the display of a frame image to be displayed by the display panel in another embodiment of the present disclosure, each row of the sub-pixels (FIG. 6 shows four rows of sub-pixels G1-G4 as an example) displays each sub-frame image in turn according to the order of the light-emitting time $T_i$ from long to short. When each frame image is displayed, the situation where when the first row of sub-pixels of the $N^{th}$ image frame is lit, the last row of sub-pixels of the $(N-1)^{th}$ frame image is still being lit can be avoided.

Furthermore, in the driving method provided in the embodiment of the present disclosure, when all sub-pixels in one sub-frame image do not need to emit light, the display panel can be controlled to not input electrical signals to each sub-pixel when displaying the sub-frame image. In one or more embodiments, in order to make the sub-pixel to emit light, it is generally needed to provide a scanning signal, a light-emitting control signal, a reset signal, or the like to the sub-pixel, which is determined by the structure of the pixel circuit in the sub-pixel. In the case where all sub-pixels in the sub-frame image do not need to emit light, the sub-frame image is black. Therefore, when the sub-frame image is displayed, no electrical signal is input into each sub-pixel, thus reducing power consumption.

Figure 7:
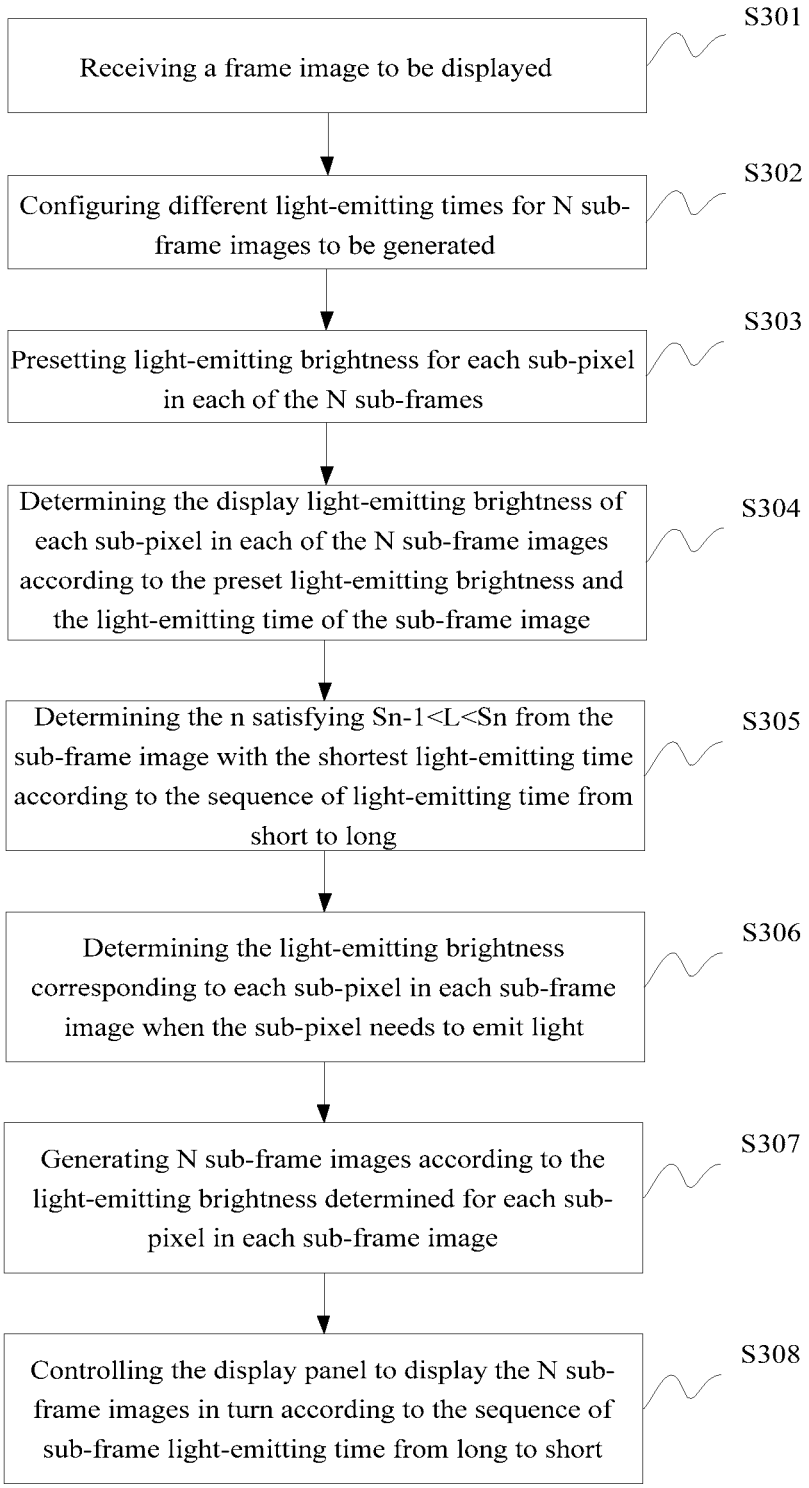
FIG. 7 is a schematic flow diagram of a driving method provided in another embodiment of the present disclosure.

The driving method provided in the embodiment of the present disclosure is explained through some embodiments. In one embodiment, as shown in FIG. 7 which is a flow diagram of a driving method provided in another embodiment of the present disclosure, the driving method includes:

S301: receiving a frame image to be displayed;

S302: configuring different light-emitting times for N sub-frame images to be generated: $T_1<T2< \ldots <T_i> \ldots <T_{N-1}<T_N$;

S303: presetting light-emitting brightness for each sub-pixel in each of the N sub-frame images;

S304: determining the display light-emitting brightness of the sub-pixel in each of the N sub-frame images according to the preset light-emitting brightness and the light-emitting time of the sub-frame image;

for example, the display brightness of the sub-pixel in the $i^{th}$ sub-frame image is $$L(i) = \frac{T_i L_i}{T_f};$$

here, $L_i$ represents the preset light-emitting brightness. Furthermore, the light-emitting brightness is preset to the maximum light-emitting brightness of the sub-pixel.

S305: determining the n satisfying $S_{n-1}<L<S_n$ from the sub-frame image with the shortest light-emitting time according to the sequence of light-emitting time from short to long; that is, that the sub-pixel needs to emit light in the first n sub-frames, and does not need to emit light in the $n^{th}$ sub-frame to $N^{th}$ sub-frame is determined;

S306: determining the light-emitting brightness corresponding to each sub-pixel in each sub-frame image when the sub-pixel needs to emit light;

where, the light-emitting brightness corresponding to the sub-pixel in the first sub-frame image to the $(n-1)^{th}$ sub-frame image is determined to be equal to the maximum light-emitting brightness of the sub-pixel; the light-emitting brightness $L_n$ corresponding to the sub-pixel in the $n^{th}$ sub-frame image is calculated according to the following formula:

$$L_n = \frac{L - S_{n-1}}{T_n} T_f$$

$$S_{n-1} = \sum_{i=1}^{n-1} \frac{T_i}{T_f} L_M$$

S307: generating N sub-frame images according to the light-emitting brightness determined for each sub-pixel in each sub-frame image; and S308: controlling the display panel to display the N sub-frame images in turn according to the sequence of sub-frame light-emitting time from long to short.

In one or more embodiments, when the display panel is controlled to display each sub-frame image, the sub-pixel in the sub-frame image that needs to emit light is controlled to emit light according to the corresponding light-emitting brightness in the corresponding light-emitting time of the sub-frame image.

According to the above driving method for pulse width and voltage hybrid modulation provided in the embodiment of the present disclosure, in one frame time, the display brightness of the sub-pixel is not only determined by the light-emitting time of the light-emitting sub-frame, but also by the light-emitting brightness of the sub-pixel, and the light-emitting brightness of the sub-pixel is determined by the data voltage. So, compared with the simple PWM modulation, adjustment of the data voltage is added so that the low gray scale brightness can be accurately displayed, and few sub-frames can be adopted.

Figure 8:
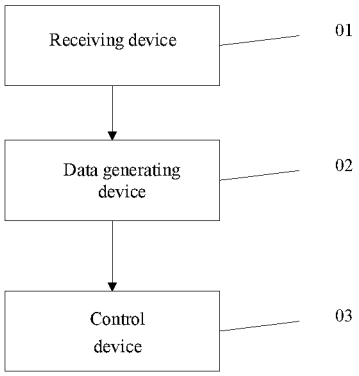
FIG. 8 is a schematic structural diagram of a driving device provided in an embodiment of the present disclosure.

Based on the same concept, the embodiment of the present disclosure also provides a driving device. As shown in FIG. 8 which is a structural diagram of a driving device provided in an embodiment of the present disclosure, the driving device includes:

a receiving device 01 configured to receive a frame image to be displayed;

a data generating device 02 configured to determine there are N sub-frame images to be generated in the frame image to be displayed according to the number of sub-frames N in one frame in a preset PWM framework; configure a light-emitting time for each of the N sub-frame images to be generated, where N is a positive integer greater than 1; and generate N sub-frame images from the frame image to be displayed according to the light-emitting time configured for the each of the N sub-frame images to be generated; where the light-emitting brightness corresponding to each sub-pixel in each of N sub-frame images is determined by the display brightness corresponding to each sub-pixel in the frame image to be displayed and the light-emitting time configured for the each of the N sub-frame images, and the light-emitting brightness corresponding to the each sub-pixel belongs to a preset light-emitting range that is greater than or equal to the minimum light-emitting brightness of the sub-pixel and less than or equal to the maximum light-emitting brightness of the sub-pixel; and a control device 03 configured to control a display panel to display N sub-frame images in turn, and control, when each of the N sub-frame images is displayed, the sub-pixel in each sub-frame images that needs to emit light to emit light according to the corresponding light-emitting brightness in the light-emitting time corresponding to the each of the N sub-frame images.

According to the driving device provided in the embodiment of the present disclosure, in one frame time, the display brightness of the sub-pixel is not only determined by the light-emitting time of the light-emitting sub-frame, but also by the light-emitting brightness of the sub-pixel, and the light-emitting brightness of the sub-pixel is determined by the data voltage. So, compared with the simple PWM modulation, adjustment of the data voltage is added so that the low gray scale brightness can be accurately displayed, and few sub-frames can be adopted.

In one or more embodiments, in the driving device provided in the embodiment of the present disclosure, the data generating device configured to configure the light-emitting time for each sub-frame image in the N sub-frame images to be generated is configured to:

configure different light-emitting times for each of the N sub-frame images to be generated.

In one or more embodiments, in the driving device provided in the embodiment of the present disclosure, the data generating device configured to generate N sub-frame images from the frame image to be displayed is configured to:

determine whether each sub-pixel in the frame image to be displayed needs to emit light in each of the N sub-frame images to be generated and if yes, the corresponding light-emitting brightness, according to the light-emitting time configured for the each of the N sub-frame images to be generated and the display brightness corresponding to each sub-pixel in the frame image to be displayed, so that in the N sub-frame images to be generated, a duration of a sub-frame in which a sub-pixel needs to emit light is shorter than that of a sub-frame in which the sub-pixel does not need to emit light; and generate N sub-frame images according to the light-emitting time configured for the each of the N sub-frame images to be generated and the light-emitting brightness corresponding to each sub-pixel in each of the N sub-frame images.

In one or more embodiments, in the driving device provided in the embodiment of the present disclosure, the data generating device configured to determine whether each sub-pixel in the frame image to be displayed needs to emit light in each sub-frame image of the N sub-frame images to be generated is configured to:

preset light-emitting brightness for the each sub-pixel in each of the N sub-frame images to be generated, and determine display brightness of each of the N sub-frame images to be generated according to the preset light-emitting brightness and the light-emitting time of the each sub-frame of the N sub-frame images to be generated; when a quantity of light-emitting sub-frame images is n, a sum of display brightness of n sub-frame images is greater than or equal to the display brightness of the frame image to be displayed, and when a sum of display brightness of any n−1 sub-frame images in the n sub-frame images is less than the display brightness of the frame image to be displayed, sub-pixels in other N-n sub-frame images do not need to emit light; where n is a positive integer, and n=1~N.

In one or more embodiments, in the driving device provided in the embodiment of the present disclosure, the data generating device configured to determine whether each sub-pixel in the frame image to be displayed needs to emit light in each of the N sub-frame images to be generated is further configured to:

for each sub-pixel, from a sub-frame image with a shortest light-emitting time in a sequence of light-emitting time from short to long, determine whether the each sub-pixel needs to emit light in the corresponding sub-frame image according to the preset light-emitting brightness.

In one or more embodiments, in the driving device provided in the embodiment of the present disclosure, the preset light-emitting brightness is the maximum light-emitting brightness of the sub-pixel.

In one or more embodiments, in the driving device provided in the embodiment of the present disclosure, light-emitting brightness corresponding to a sub-pixel in the sub-frame image with a longest light-emitting time is less than or equal to light-emitting brightness corresponding to the sub-pixel in any other light-emitting sub-frame images.

In one or more embodiments, in the driving device provided in the embodiment of the present disclosure, the data generating device configured to determine the corresponding light-emitting brightness of each sub-pixel in the frame image to be displayed in each of the N sub-frame images when the sub-pixel needs to emit light is configured to:

for each sub-pixel that needs to emit light, determine light-emitting brightness corresponding to the each sub-pixel in a first sub-frame image to a $(n-1)^{th}$ sub-frame image to be equal to maximum light-emitting brightness of the each sub-pixel;

where the light-emitting brightness $L_n$ corresponding to the each sub-pixel in a $n^{th}$ sub-frame image is calculated according to the following formula:

$$L_n = \frac{L - S_{n-1}}{T_n} T_f$$

$$S_{n-1} = \sum_{i=1}^{n-1} \frac{T_i}{T_f} L_M;$$

where, $S_{n-1}$ represents a sum of display brightness corresponding to the each sub-pixel in the first n−1 sub-frame images, L represents the display brightness corresponding to the each sub-pixel in the frame image to be displayed, $T_i$ represents a light-emitting time configured for an $i^{th}$ sub-frame image, $L_M$ represents the maximum light-emitting brightness of the each sub-pixel, and $T_f$ represents one frame time.

In one or more embodiments, in the driving device provided in the embodiment of the present disclosure, the control device configured to control the display panel to display N sub-frame images in turn is configured to:

control the display panel to display each of the N sub-frame images in turn according to a sequence of the light-emitting time configured for each of the N sub-frame images to be generated from long to short.

In one or more embodiments, in the driving device provided in the embodiment of the present disclosure, the control device for controlling the display panel to display N sub-frame images in turn specifically refers to:

control the display panel to display each of the N sub-frame image in turn according to a sequence of the light-emitting time configured for each of the N sub-frame images to be generated from short to long.

In one or more embodiments, in the driving device provided in the embodiment of the present disclosure, when all sub-pixels in one sub-frame image do not need to emit light, the display panel is controlled to not input electrical signals to each sub-pixel in the sub-frame image when displaying the sub-frame image.

In one or more embodiments, in the driving device provided in the embodiment of the present disclosure, $4 \le N \le 6$.

In one or more embodiments, in the driving device provided in the embodiment of the present disclosure, the data generating device is used for configuring the light-emitting time for each of the N sub-frame images to be generated according to the following formula:

$$T_i \propto \gamma\left(\frac{i}{N} G_M\right);$$

$T_i$ represents a light-emitting time corresponding to an $i^{th}$ sub-frame, $G_M$ represents a maximum gray scale value of the display panel, and γ represents a mapping relationship between a gray scale value and a display brightness value.

It should be noted that since the principle adopted by the driving device provided in the embodiment of the present disclosure to solve the problem is similar to the aforementioned driving method, the driving device can be implemented with reference to the implementation of the aforementioned driving method, and repeated description will not be given here.

Figure 9:
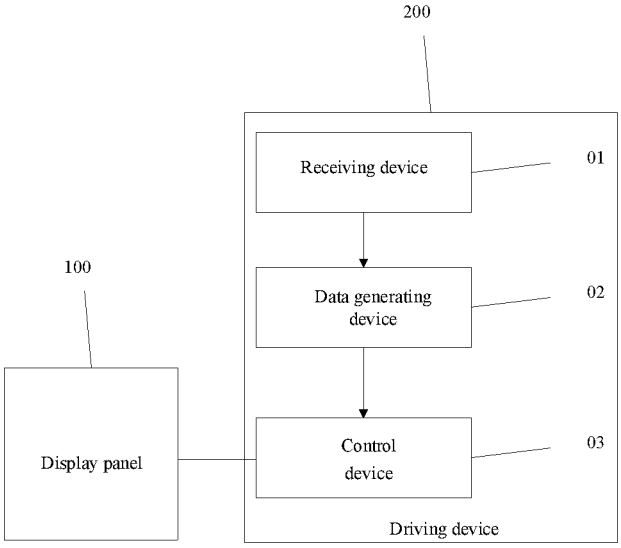
FIG. 9 is a schematic structural diagram of a display device provided in an embodiment of the present disclosure.

Based on the same concept, the embodiment of the present disclosure also provides a display device. As shown in FIG. 9 which is a structural diagram of a display device provided in an embodiment of the present disclosure, the display device includes a display panel 100, and a driving device 200 provided in the embodiment of the present disclosure, where the driving device 200 is used to drive the display panel 100 for display. Since the principle adopted by the display device to solve the problem is similar to that of the driving device mentioned above, the display device can be implemented with reference to the implementation of the driving device mentioned above, and repeated description will not be given here.

Figure 10:
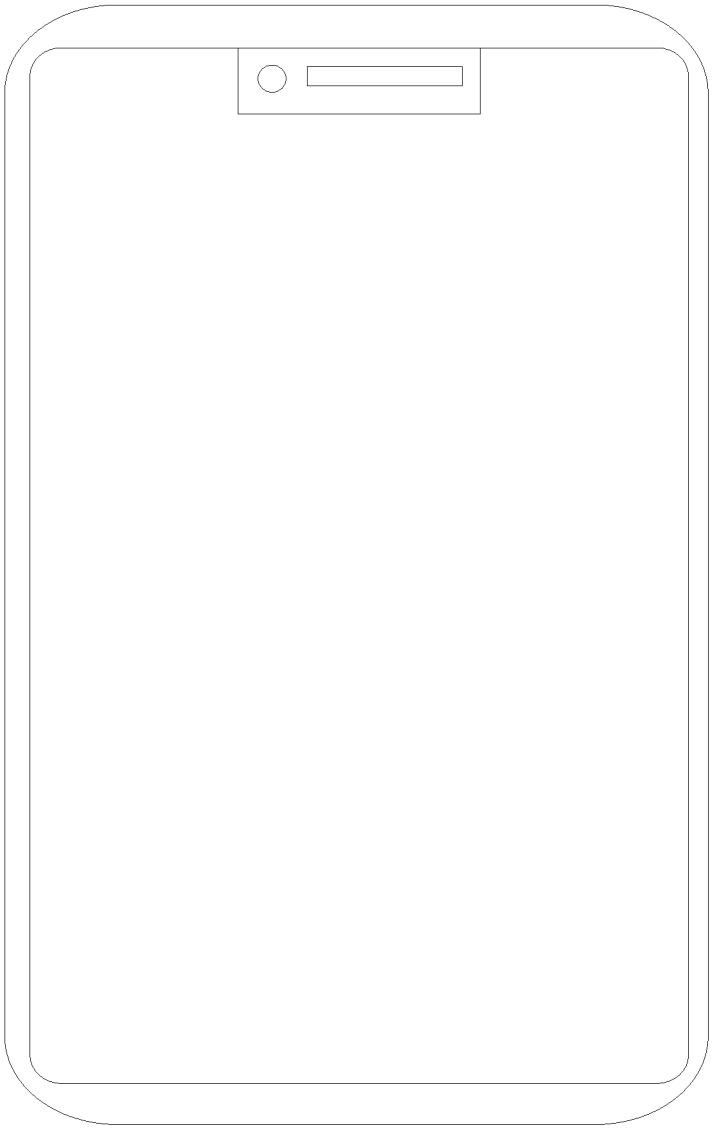
FIG. 10 is a schematic structural diagram of a display device provided in another embodiment of the present disclosure.

In one or more embodiments, the display device can be any product or component with a display function, such as a mobile phone, a tablet computer, a television, a display, a notebook a computer, a digital photo frame, a navigator, or the like, as shown in FIG. 10. The display device can be implemented with reference to the implementation of the display panel, and repeated description will not be given here.

According to the driving method for pulse width and voltage hybrid modulation, the driving device and the display device provided in the embodiment of the present disclosure, after receiving the frame image to be displayed is received, N sub-frame images are determined to be generated from the received frame image to be displayed according to the number of the sub-frames N in one frame in the preset PWM framework, N sub-frame images are generated from the frame image to be displayed after the light-emitting time and corresponding light-emitting brightness are configured for each of the N sub-frame images; then the display panel is controlled to display the N sub-frame images in turn, and when each of the N sub-frame images is displayed, the sub-pixel that needs to emit light in the sub-frame image is controlled to emit light according to the corresponding light-emitting brightness in the light-emitting time corresponding to each of the N sub-frame images; In one sub-frame image, the light-emitting brightness of the sub-pixel is determined by the display brightness corresponding to the sub-pixel in the frame image to be displayed, and the light-emitting time configured for the sub-frame image; the light-emitting brightness corresponding to each sub-pixel lies in the range that is greater than or equal to the minimum light-emitting brightness of the sub-pixel and less than or equal to the maximum light-emitting brightness of the sub-pixel. That is, in one frame time, the display brightness of the sub-pixel is not only determined by the light-emitting time of the light-emitting sub-frame, but also by the light-emitting brightness of the sub-pixel, and the light-emitting brightness of the sub-pixel is determined by the data voltage. Therefore, compared with the simple PWM modulation, adjustment of the data voltage is added so that the low gray scale brightness can be accurately displayed, and the number of sub-frames can be fewer.

What is claimed is:

1. A driving method for pulse width and voltage hybrid modulation, comprising:

receiving a frame image to be displayed;

determining there are N sub-frame images to be generated in the frame image to be displayed according to a quantity of sub-frames N in one frame in a preset PWM framework;

configuring a light-emitting time for each of N sub-frame images to be generated, with different light-emitting times configured for different sub-frame images, wherein N is a positive integer greater than 1;

determining whether each sub-pixel in the frame image to be displayed needs to emit light in each of the N sub-frame images to be generated and if yes, the corresponding light-emitting brightness, according to the light-emitting time configured for the each of the N sub-frame images to be generated and the display brightness corresponding to each sub-pixel in the frame image to be displayed, so that in the N sub-frame images to be generated, a duration of a sub-frame in which a sub-pixel needs to emit light is shorter than that of a sub-frame in which the sub-pixel does not need to emit light and generating N sub-frame images according to the light-emitting time configured for the each of the N sub-frame images to be generated and the light-emitting brightness corresponding to each sub-pixel in each of the N sub-frame images;

wherein, light-emitting brightness corresponding to each sub-pixel in each of the N sub-frame images is determined by display brightness corresponding to each sub-pixel in the frame image to be displayed and the light-emitting time configured for the each of the N sub-frame images; wherein the light-emitting brightness of each sub-pixel lies in a preset brightness range that is greater than or equal to minimum light-emitting brightness of each sub-pixel and less than or equal to maximum light-emitting brightness of the sub-pixel; and controlling a display panel to display the N sub-frame images in turn, and controlling, when the each of the N sub-frame images is displayed, a sub-pixel that needs to emit light in the each of N sub-frame images to emit light according to corresponding light-emitting brightness in the light-emitting time corresponding to the each of the N sub-frame images.

2. The driving method according to claim 1, wherein determining whether each sub-pixel in the frame image to be displayed needs to emit light in each of the N sub-frame images to be generated comprises:

presetting light-emitting brightness for each sub-pixel in each of the N sub-frame images to be generated, and;

determining display brightness of each of the N sub-frame images to be generated according to the preset light-emitting brightness and the light-emitting time of the each of the N sub-frame images to be generated;

wherein, when a quantity of light-emitting sub-frame images is n, a sum of display brightness of n sub-frame images is greater than or equal to the display brightness of the frame image to be displayed, and when a sum of display brightness of any n−1 sub-frame images in the n sub-frame images is less than the display brightness of the frame image to be displayed, sub-pixels in other N−n sub-frame images do not need to emit light; wherein n is a positive integer, and n=1~N.

3. The driving method according to claim 2, wherein determining whether each sub-pixel in the frame image to be displayed needs to emit light in each of the N sub-frame images to be generated further comprises:

for each sub-pixel, from a sub-frame image with a shortest light-emitting time in a sequence of light-emitting time from short to long, determining whether the each sub-pixel needs to emit light in a corresponding sub-frame image according to the preset light-emitting brightness.

4. The driving method according to claim 3, wherein the preset light-emitting brightness is the maximum light-emitting brightness of the sub-pixel.

5. The driving method according to claim 4, wherein light-emitting brightness corresponding to a sub-pixel in the sub-frame image with a longest light-emitting time is less than or equal to light-emitting brightness corresponding to the sub-pixel in any other light-emitting sub-frame images.

6. The driving method according to claim 5, wherein determining the light-emitting brightness corresponding to each sub-pixel in the frame image to be displayed in each of the N sub-frame images when the sub-pixel needs to emit light comprises:

for each sub-pixel that needs to emit light, determining light-emitting brightness corresponding to each sub-pixel in a first sub-frame image to a $(n-1)^{th}$ sub-frame image to be equal to maximum light-emitting brightness of each sub-pixel; and calculating light-emitting brightness $L_n$ corresponding to each sub-pixel in a $n^{th}$ sub-frame image according to a following formula:

$$L_n = \frac{L - S_{n-1}}{T_n} T_f$$

$$S_{n-1} = \sum_{i=1}^{n-1} \frac{T_i}{T_f} L_M;$$

wherein, $S_{n-1}$ represents a sum of display brightness corresponding to each sub-pixel in first n−1 sub-frame images, L represents display brightness corresponding to each sub-pixel in the frame image to be displayed, $T_i$ represents a light-emitting time configured for an $i^{th}$ sub-frame image, $L_M$ represents the maximum light-emitting brightness of each sub-pixel, and $T_f$ represents one frame time.

7. The driving method according to claim 1, wherein controlling a display panel to display N sub-frame images in turn comprises:

controlling the display panel to display each of the N sub-frame images in turn according to a sequence of the light-emitting time configured for each of the N sub-frame images to be generated from long to short.

8. The driving method according to claim 1, wherein controlling a display panel to display N sub-frame images in turn comprises:

controlling the display panel to display each of the N sub-frame images in turn according to a sequence of the light-emitting time configured for each of the N sub-frame images to be generated from short to long.

9. The driving method according to claim 1, wherein when all sub-pixels in one sub-frame image do not need to emit light, the display panel is controlled to not input electrical signals to each sub-pixel in the sub-frame image when the sub-frame image is displayed.

10. The driving method according to claim 1, wherein $4 \leq N \leq 6$.

11. The driving method according to claim 1, wherein the light-emitting time is configured for each of the N sub-frame images to be generated according to a following formula:

$$T_i \propto \gamma\left(\frac{i}{N} G_M\right);$$

$T_i$ represents a light-emitting time corresponding to an $i^{th}$ sub-frame, $G_M$ represents a maximum gray scale value of the display panel, and γ represents a mapping relationship between a gray scale value and a display brightness value.

12. A driving device, comprising:

a receiving device configured to receive a frame image to be displayed;

a data generating device configured to: determine there are N sub-frame images to be generated in the frame image to be displayed according to a quantity of sub-frames N in one frame in a preset PWM framework; configure a light-emitting time for each of N sub-frame images to be generated, with different light-emitting times configured for different sub-frame images, wherein N is a positive integer greater than 1; determine whether each sub-pixel in the frame image to be displayed needs to emit light in each of the N sub-frame images to be generated and if yes, the corresponding light-emitting brightness, according to the light-emitting time configured for the each of the N sub-frame images to be generated and the display brightness corresponding to each sub-pixel in the frame image to be displayed, so that in the N sub-frame images to be generated, a duration of a sub-frame in which a sub-pixel needs to emit light is shorter than that of a sub-frame in which the sub-pixel does not need to emit light and generate N sub-frame images according to the light-emitting time configured for the each of the N sub-frame images to be generated and the light-emitting brightness corresponding to each sub-pixel in each of the N sub-frame images; wherein, light-emitting brightness corresponding to each sub-pixel in each of the N sub-frame images is determined by display brightness corresponding to each sub-pixel in the frame image to be displayed and the light-emitting time configured for the each of the N sub-frame images; wherein the light-emitting brightness of each sub-pixel lies in a preset brightness range that is greater than or equal to minimum light-emitting brightness of each sub-pixel and less than or equal to maximum light-emitting brightness of each sub-pixel; and a control device configured to control a display panel to display the N sub-frame images in turn, and control, when the each of the N sub-frame images is displayed, a sub-pixel that needs to emit light in the each of N sub-frame images to emit light according to corresponding light-emitting brightness in the light-emitting time corresponding to the each of the N sub-frame images.

13. A display device, comprising a display panel and a driving device used to drive the display panel to display;

wherein the driving device comprises:

a receiving device configured to receive a frame image to be displayed;

a data generating device configured to: determine there are N sub-frame images to be generated in the frame image to be displayed according to a quantity of sub-frames N in one frame in a preset PWM framework; configure a light-emitting time for each of N sub-frame images to be generated, with different light-emitting times configured for different sub-frame images, wherein N is a positive integer greater than 1; determine whether each sub-pixel in the frame image to be displayed needs to emit light in each of the N sub-frame images to be generated and if yes, the corresponding light-emitting brightness, according to the light-emitting time configured for the each of the N sub-frame images to be generated and the display brightness corresponding to each sub-pixel in the frame image to be displayed, so that in the N sub-frame images to be generated, a duration of a sub-frame in which a sub-pixel needs to emit light is shorter than that of a sub-frame in which the sub-pixel does not need to emit light and generate N sub-frame images according to the light-emitting time configured for the each of the N sub-frame images to be generated and the light-emitting brightness corresponding to each sub-pixel in each of the N sub-frame images; wherein, light-emitting brightness corresponding to each sub-pixel in each of the N sub-frame images is determined by display brightness corresponding to each sub-pixel in the frame image to be displayed and the light-emitting time configured for the each of the N sub-frame images; wherein the light-emitting brightness of each sub-pixel lies in a preset brightness range that is greater than or equal to minimum light-emitting brightness of each sub-pixel and less than or equal to maximum light-emitting brightness of each sub-pixel; and a control device configured to control a display panel to display the N sub-frame images in turn, and control, when the each of the N sub-frame images is displayed, a sub-pixel that needs to emit light in the each of N sub-frame images to emit light according to corresponding light-emitting brightness in the light-emitting time corresponding to the each of the N sub-frame images.

* * * * *